US006955703B2

(12) United States Patent
Zhou et al.

(10) Patent No.: US 6,955,703 B2
(45) Date of Patent: Oct. 18, 2005

(54) PROCESS FOR THE PRODUCTION OF ELEMENTAL MATERIAL AND ALLOYS

(75) Inventors: Ling Zhou, Severna Park, MD (US); Frederick E. L. Schneider, Jr., Baltimore, MD (US); Robert J. Daniels, Phoenix, MD (US); Thomas Messer, Columbia, MD (US); Jon Philip R. Peeling, Finksburg, MD (US)

(73) Assignee: Millennium Inorganic Chemicals, Inc., Hunt Valley, MD (US)

( * ) Notice: Subject to any disclaimer, the term of this patent is extended or adjusted under 35 U.S.C. 154(b) by 46 days.

(21) Appl. No.: 10/329,721

(22) Filed: Dec. 26, 2002

(65) Prior Publication Data

US 2004/0123700 A1 Jul. 1, 2004

(51) Int. Cl.[7] ..... B22F 9/28
(52) U.S. Cl. ..... 75/351; 75/366; 75/617; 75/619; 75/620
(58) Field of Search ..... 75/351, 366, 617, 75/619, 620

(56) References Cited

U.S. PATENT DOCUMENTS

| | | | | |
|---|---|---|---|---|
| 3,900,312 A | * | 8/1975 | Terry et al. | 75/676 |
| 4,356,029 A | | 10/1982 | Down et al. | |
| 4,477,277 A | * | 10/1984 | D'Altilia et al. | 75/367 |
| 4,830,665 A | * | 5/1989 | Winand | 164/475 |
| 4,877,445 A | | 10/1989 | Okudaira et al. | |
| 5,421,855 A | * | 6/1995 | Hayden et al. | 75/393 |
| 5,779,761 A | * | 7/1998 | Armstrong et al. | 75/370 |
| 5,958,106 A | | 9/1999 | Armstrong et al. | |
| 6,737,017 B2 | | 5/2004 | Woodfield et al. | |
| 2003/0230170 A1 | | 12/2003 | Woodfield et al. | |
| 2003/0231974 A1 | | 12/2003 | Woodfield et al. | |
| 2004/0016319 A1 | | 1/2004 | Woodfield et al. | |
| 2004/0035509 A1 | | 2/2004 | Woodfield | |
| 2004/0050208 A1 | * | 3/2004 | Nie et al. | 75/369 |
| 2004/0084117 A1 | | 5/2004 | Woodfield et al. | |
| 2004/0089380 A1 | | 5/2004 | Woodfield | |

(Continued)

FOREIGN PATENT DOCUMENTS

| | | | |
|---|---|---|---|
| EP | 1 428 896 | | 6/2004 |
| WO | WO-01/45906 A2 | * | 6/2001 |
| WO | WO-03/106080 A1 | | 12/2003 |
| WO | WO-03/106081 A1 | | 12/2003 |
| WO | WO-2004/011685 A1 | | 2/2004 |

OTHER PUBLICATIONS

H.Y. Sohn, Ti and TiAl Powders by the Flash Reduction of Chloride Vapors, JOM, Sep. 1998; pp. 50–51.

Kirk–Othmer, Encyclopedia of Chemical Technology, Titanium and Titanium Alloys, 4th Edition, vol. 24, pp. 186 to 224.

J. Barksdale, Titanium, Its Occurrence, Chemistry and Technology, 2nd Edition, The Ronald Press Company, New York, 1968, pp. 145 to 184.

J.W. Reeves, Emerging Technology for Metal Production—A comparison of some new titanium metal technologies with DuPont R&D and commercial results through the 1960's, EPD Congress 2001, Edited by P.R. Taylor, TMS (The Minerals, Metals & Materials Society), 2001, pp. 5–12.

*Primary Examiner*—George Wyszomierski
(74) *Attorney, Agent, or Firm*—Connolly Bove Lodge & Hutz LLP

(57) ABSTRACT

The present invention relates to a process for the production of an elemental material, comprising the step of reacting a halide of the elemental material with a reducing agent in solid form in a fluidized bed reactor at a reaction temperature which is below the melting temperature of the reducing agent. In a preferred embodiment of the present invention, the elemental material is titanium and the titanium is produced in powder form. The invention also relates to the production of alloys or intermetallics of the elemental materials.

19 Claims, 3 Drawing Sheets

Process for Producing Titanium Powder

U.S. PATENT DOCUMENTS

2004/0115085 A1 6/2004 Steibel et al.
2004/0118245 A1 6/2004 Ott et al.
2004/0118246 A1 6/2004 Woodfield et al.
2004/0118247 A1 6/2004 Woodfield et al.
2004/0120841 A1 6/2004 Ott et al.
2004/0141869 A1 7/2004 Ott et al.
2004/0146640 A1 7/2004 Ott et al.

* cited by examiner

Figure 1. Process for Producing Titanium Powder

Figure 2. Process for Producing Titanium Silicides

PROCESS FOR THE PRODUCTION OF ELEMENTAL MATERIAL AND ALLOYS

BACKGROUND OF THE INVENTION (1) Field of the Invention

The present invention relates to a process for the production of an elemental material, comprising the step of reacting a halide of the elemental material with a reducing material in solid form in a fluidized bed reactor at a reaction temperature which is below the melting temperature of the reducing material. In a preferred embodiment of the present invention, the elemental material is titanium and the titanium is produced in powder form. The invention also relates to the production of alloys and intermetallic compounds of the elemental materials.

(2) Description of Related Art

The Kroll process and the Hunter process are the two present day methods of producing titanium commercially. In the Kroll process, titanium tetrachloride is chemically reduced by magnesium at temperatures between 800 and 900° C. The process is conducted in a batch fashion in a metal (steel) retort with an inert atmosphere (usually helium or argon). Magnesium is charged into the vessel and heated to prepare a molten magnesium bath. Liquid titanium tetrachloride at room temperature is dispersed dropwise above the molten magnesium bath. The liquid titanium tetrachloride vaporizes in the gaseous zone above the molten magnesium bath. A reaction occurs on the molten magnesium surface to form titanium and magnesium chloride. The Hunter process is similar to the Kroll process, but uses sodium instead of magnesium to reduce the titanium tetrachloride to titanium metal and produces sodium chloride as a by-product. For both processes, the reaction is uncontrolled and sporadic and promotes the growth of dendritic titanium metal. The titanium fuses into a mass that encapsulates some of the molten magnesium (or sodium) chloride. This fused mass is called titanium sponge. After cooling of the metal retort, the solidified titanium sponge metal is broken up, crushed, purified either by vacuum distillation or acid leach and then dried in a stream of hot nitrogen. Metal ingots are made by compacting the sponge, welding pieces into an electrode and then melting it into an ingot in a high vacuum arc furnace. High purity ingots require multiple arc melting operations.

Powder titanium is usually produced from the sponge through grinding, shot casting or centrifugal processes. A common technique is to first react the titanium with hydrogen to make brittle titanium hydride to facilitate the grinding process. After formation of the powder titanium hydride, the particles are dehydrogenated to produce a usable metal powder product. The processing of the titanium sponge into a usable form is difficult, labor intensive, and increases the product cost by a factor of two to three.

The processes discussed above have several intrinsic problems that contribute heavily to the high cost of titanium production. Both processes are batch processes and batch process production is inherently capital and labor intensive. The processes also suffer from low productivity because the reactor has to be charged, heated, and discharged, which involves a long down time between batches. Furthermore, due to the batch nature of these processes, there is significant quality variation in the titanium metal produced from batch to batch. Additionally, the titanium sponge produced by these processes requires further substantial processing to produce titanium in a usable form; thereby increasing cost, increasing hazard to workers and exacerbating batch quality control difficulties. In addition, both processes are energy intensive and neither process utilizes the large exothermic energy reaction, requiring substantial energy input for titanium production (approximately 6 kW-hr/kg product metal).

The titanium tetrachloride used in the commercial production of titanium metal is usually obtained by chlorinating relatively high-grade titanium dioxide ore, which also partially contributes to the high cost of the metal. Chlorination of lower grade ores such as ilmenite, synthetic rutile, and slag, which has been developed by the $TiO_2$ pigment manufacturers, greatly reduces the cost of $TiCl_4$.

The reduction of titanium tetrachloride to metal has been attempted using a number of reducing agents including hydrogen, carbon, sodium, calcium, aluminum and magnesium. As discussed above, both the magnesium and sodium reduction of titanium tetrachloride have proved to be commercial methods for producing titanium metal. However, also as discussed above, the current commercial methods use batch processing, which is undesirable.

The greatest potential for decreasing the production cost associated with the commercial production of titanium metal is the development of a continuous reduction process with attendant reduction in material handling. There is a strong demand for both the development of a process that enables continuous economical production of titanium metal and for the production of metal powder suitable for use, without additional processing, for application to powder metallurgy or for vacuum-arc melting to ingot form.

BRIEF SUMMARY OF THE INVENTION

The present invention relates to a process for the production of an elemental material, preferably in powder form, comprising the step of reacting a halide of the elemental material with a reducing material in solid form in a fluidized bed reactor at a reaction temperature which is below the melting temperature of the reducing material. In a preferred embodiment of the present invention, the elemental material is titanium and the titanium is produced in powder form. The invention also relates to the production of alloys and intermetallic compounds of the elemental materials.

The present invention contains certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

DETAILED DESCRIPTION OF THE INVENTION AND PREFERRED EMBODIMENTS

Figure 1:
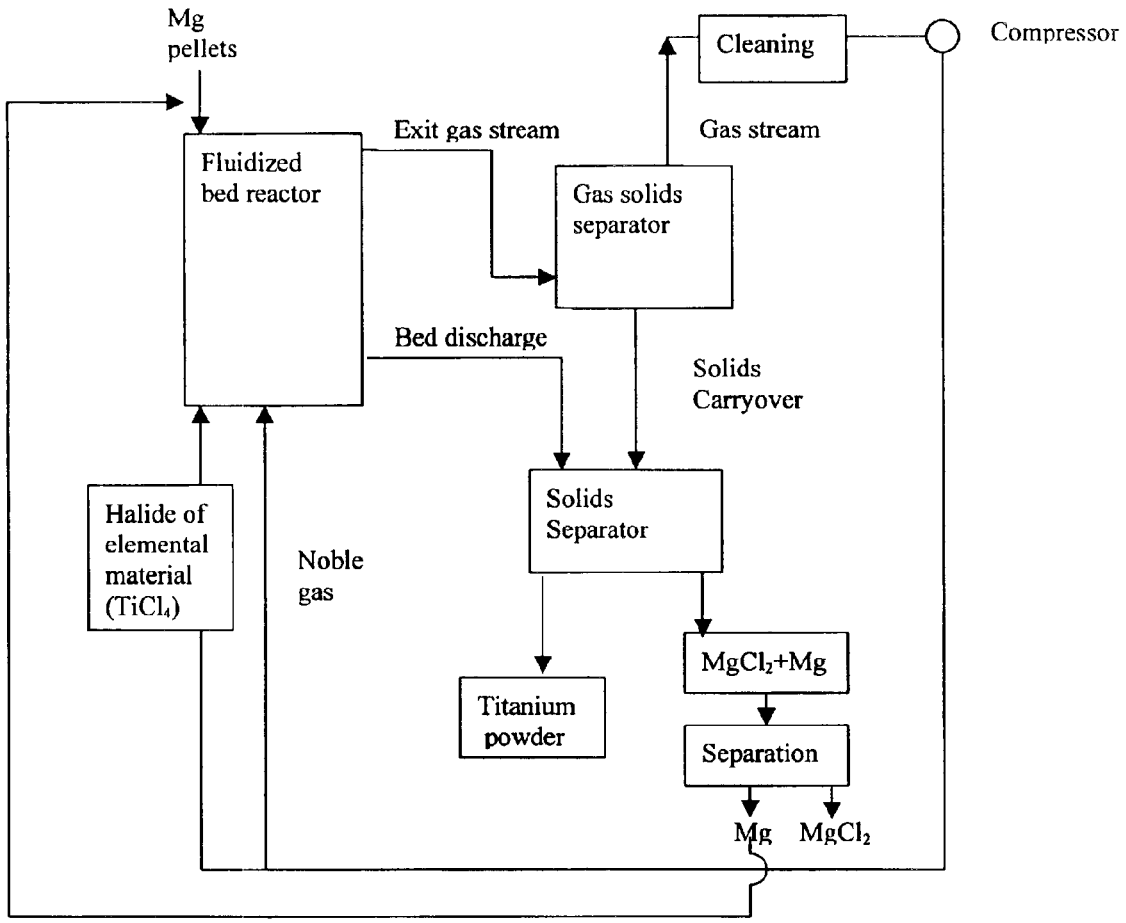
FIG. 1 is a schematic of a process according to the present invention for producing an elemental material (titanium metal) in powder form.

The present invention comprises a process for the production of elemental material and alloys in a powder form by a reduction reaction in a fluidized bed reactor.

In the embodiment of the present invention wherein an elemental material is to be produced, the feed to the fluidized bed reactor comprises a halide of the elemental material to be produced, a reducing agent (e.g., magnesium metal) in solid form (e.g., granules or pellets), and a fluidizing gas (e.g., a noble gas such as helium or argon). The halide of the elemental material to be produced is introduced into the bottom of the fluidized bed, usually in liquid or vapor form. Although the halide may be introduced to the bed in liquid form, the conditions at the point of entrance should be such that the halide at least partially vaporizes before it contacts the bed material. Preferably, the halide of the elemental material is fully vaporized before it contacts the bed material in the fluidized bed reactor. The bed itself comprises the reducing agent in solid form initially. The halide of the elemental material reacts with the reducing agent in the fluidized bed to form the elemental material in powder form and a halide of the reducing agent. The bed height is maintained by the continuous feeding of reducing agent to the bed and the discharging of bed material when a certain bed height is reached. The gas stream exiting the reactor is separated in a gas-solids separator to form a gas stream and carryover solids. The gas stream is compressed in a compressor after cleaning and then sent back to the fluidized bed as part or all of the fluidizing stream. The carryover solids, along with the bed discharge, is subjected to a separation step to separate the elemental material from the halide and the remains of the reducing agent. After this separation step, the bed material (i.e., the reducing agent) is preferably sent back to the bed and the elemental material and the halide of the reducing agent are separated into a product stream and a by-product stream.

In the embodiment of the present invention where alloys and intermetallic compounds are formed, the feed material comprises a halide of one of the elements that make up the final alloy or intermetallic compound and the reducing agent comprises the other element(s) of the final alloy or intermetallic compound. The reduction reaction between the feed material and the reducing agent can either produce the final alloy or intermetallic compound or a subsequent process step, such as a sintering step, can be used to form the final alloy or intermetallic compound from the reaction products produced in the reduction reaction. Alternatively, the feed material can be a halide of an alloy or intermetallic compound and the reducing agent can be an element or compound that strips the halide atom(s) from the alloy or intermetallic compound to form the final alloy or intermetallic compound or to form reaction product(s) that can be further processed (e.g., by heating) to form the final alloy or intermetallic compound. Still further, the feed material can be a halide of two or more different elements and the reducing agent can comprise one or more additional elements that are necessary to form the final alloy or intermetallic compound. In this embodiment of the present invention, the reduction reaction either produces the final alloy or intermetallic compound or the reaction produces reaction products that can be further processed (e.g., by a subsequent heating step) to form the final alloy or intermetallic compound. Finally, the feed material can be a mixture of halides of the elemental materials that make up the alloy and the reducing agent is an element or compound that strips the halide atoms from the feed material. When the feed material comprises a mixture of halides of the elemental materials that make up the alloy, each of the halides of the elemental materials is fed to the reactor in a proportion that is equivalent to the proportion of that elemental material in the alloy. Further, as discussed above, in situations where the reduction reaction results in a mixture of the elemental materials that make up the final alloy or intermetallic compound, the process can include a further step wherein the mixture of the elemental materials is brought to conditions (e.g., of temperature and/or pressure) which is sufficient to form the alloy or intermetallic compound.

The elemental materials that can be produced by the process of the present invention include Ti, Si, Zr, Hf, Al, As, In, Sb, Be, B, Ta, Ge, V, Nb, Mo, Ga, Ir, Os, U, Re, and the rare earth metals. As discussed above, the process can also be used to produce alloys of these elemental materials or intermetallic compounds.

The process of the present invention can be operated as a continuous process with a controlled reaction temperature. In this regard, the process is clearly superior to the batch processes of the prior art. For example, the process can be operated as a closed system, which minimizes the need for opening the reactor and handling the materials. Further, the process is much more efficient than the known batch processes because it avoids the down time between batch runs. Still further, the uniformity and quality of the elemental material produced is significantly enhanced due to the ability to control the reaction conditions and the avoidance of batch to batch variations. In addition, the process achieves the long desired goal of producing the elemental material (or alloys or intermetallics) in powder form, which eliminates many of the process steps that are necessary to turn sponge material or other aggregate-type material into powder.

In a preferred embodiment of the present invention, shown in FIG. 1, the process is used to produce titanium metal powder in a continuous manner which solves many of the problems associated with the current commercial processes for producing titanium metal. In this embodiment of the present invention, the feed to the fluidized bed reactor comprises a halide of titanium (e.g., $TiCl_4$), a reducing agent (e.g., magnesium metal) in solid form (e.g., granules or pellets), and a fluidizing gas (e.g., a noble gas such as helium or argon). The halide of titanium is introduced into the bottom of the fluidized bed, usually in liquid or vapor form, and the halide is carried through the reactor by the fluidizing gas. If the halide is introduced to the reactor in liquid form, it is preferred that the halide is completely vaporized before it contacts the bed material. Accordingly, the vaporization of the halide can occur: (1) before the halide is introduced to the reactor; (2) when the halide is introduced to the stream of fluidizing gas; or (3) after the halide is introduced to the stream of fluidizing gas, as long as most or all of the halide is vaporized when the halide contacts the bed material. The bed itself initially comprises the reducing agent in solid form. The halide of titanium, in vapor form, reacts with the reducing agent, in solid form, in the fluidized bed to form titanium metal powder and a halide of the reducing agent (e.g., $MgCl_2$), some of which are carried out of the reactor by the fluidizing gas along with some of the reducing agent. The gas stream exiting the reactor is separated in a gas-solids separator to form a gas stream and a solids carryover. The gas stream is compressed in a compressor after cleaning and then sent back to the fluidized bed as part or all of the fluidizing stream. The solids stream along with bed discharge is subjected to a separation step (e.g., vacuum distillation) to separate the titanium metal powder from the halide and the remains of the reducing agent. After this separation step, the bed material (i.e., the reducing agent) is separated from the halide (e.g., by $H_2O$ washing and filtration) and preferably sent back to the bed and the titanium metal powder and the halide of the reducing agent are separated into two streams (i.e., a product stream and a by-product stream).

It should be noted that as the reduction reaction proceeds, the composition of the fluidized bed will change as titanium powder and the halide of the reducing agent are produced and, to some extent, build up in the bed. It is expected that the composition of the fluidized bed will stop changing, or vary within a relatively narrow range, when the process is run continuously and reaches steady state.

The reaction temperature is maintained at a temperature which is below the melting temperature of the reducing agent. The melting temperature of the reducing agent may be below the actual melting point of the reducing agent (i.e., the temperature at which the reducing agent completely melts). Specifically, the melting temperature of the reducing agent is the temperature at which the particles of reducing agent stick together and form clumps or aggregate bodies that interfere with either the efficiency of the reduction reaction or the operation of the fluidized bed. For most reducing agents, the melting temperature is a temperature which is slightly below the actual melting point of the reducing agent. However, for some reducing agents, the melting temperature may be substantially below the melting point of the reducing agent. In any event, the reaction temperature should be maintained at a temperature (or in a temperature range) at which the particles of the reducing agent do not form clumps or aggregate bodies that substantially interfere with the efficiency or extent of the reduction reaction or the successful operation of the fluidized bed.

In a highly preferred embodiment of the present invention, the elemental material to be produced is titanium metal powder, the halide of titanium is $TiCl_4$, the reducing agent is magnesium metal granules or pellets, and the fluidizing gas is a noble gas (e.g., argon). The $TiCl_4$ is fed into the fluidized bed reactor, containing the magnesium granules or pellets initially, which bed is being fluidized by a stream of the noble gas. The $TiCl_4$ (in vapor form) reacts with the magnesium to produce titanium metal powder and $MgCl_2$. The temperature of the bed in the reactor is controlled so as to be in the range from about 450° C. to about 649° C., preferably in the range from about 550° C. to about 640° C. The temperature of the bed is controlled by the feed rate of $TiCl_4$ and the feed rate of the reducing agent. It can also be controlled by other means known in the art, such as direct cooling using a coil or continuous bed bleeding and feeding (e.g., wherein the bled portion of the bed is allowed to cool before it is fed back into the reactor). The titanium metal powder and $MgCl_2$ produced in the reactor, along with some of the reducing agent, are carried out of the reactor in the exhaust stream of fluidizing gas. This exhaust stream is then sent to a gas-solids separator (such as a cyclone) wherein the fluidizing gas is separated from the solid materials. The separated fluidizing gas is then cleaned (e.g., through filters and/or electrostatic devices) and subjected to compression before being sent back to the fluidized bed reactor to be used as the carry gas for $TiCl_4$ and/or the fluidizing gas for the process.

The solid materials that were separated from the fluidizing gas in the gas-solids separator, along with the bed discharge, are subjected to another separation step (e.g., leaching in a dilute acid bath, such as an aqueous bath containing hydrochloric acid having a pH in the range of from 2–6) to separate the titanium metal powder from $MgCl_2$ and the unreacted magnesium bed material. This separation step results in a solid stream containing titanium powder and an aqueous solution of $MgCl_2$.

In another embodiment of the present invention, the carryover solids that are obtained from the gas-solids separator, along with the bed discharge, are further processed by pyrometallurgy. For example, in one embodiment of the present invention, the solids that are obtained from the gas-solids separator, along with the bed discharge, are fed to a furnace to distill off the magnesium and the $MgCl_2$ at a temperature of 930° C. (preferably under a vacuum of about $2\times10^{-3}\sim3\times10^{-4}$ mmHg). The product that is obtained after this step is titanium metal powder with a very high purity (i.e., usually one percent by weight or less of impurities, preferably 0.5% by weight or less of impurities, where the primary impurity is usually oxygen).

At this stage the powder is highly reactive and has to be kept under argon. A passivation stage, whereby a thin layer of $TiO_2$ is formed on the surface, can be added to allow easier handling of the powder.

The reaction involved in this embodiment of the present invention can be represented by:

$$TiCl_4+2Mg\rightarrow Ti+2MgCl_2$$

This reaction is highly exothermic. One of the advantages of the process of the present invention is that by using a fluidized bed reactor, the heat of reaction is quickly and evenly distributed throughout the bed so that it is relatively easy to control the temperature inside the reactor. Accordingly, the magnesium reduction reaction can be allowed to proceed rapidly and the large exothermic heat of reaction can be effectively used within the reactor to maintain the desired bed temperature, thus minimizing the need to use external energy for this purpose.

The titanium metal powder that is produced by the process of the present invention is suitable for use in current powder-metallurgy techniques such as near net shape fabrication, which greatly simplifies the production of final titanium metal products in comparison to the conventional casting techniques.

By using the process of the present invention, it is possible to directly produce (i.e., without using further steps such as hydrate-dehydrate processing or other particle reduction techniques used in the Ti metal industry) large amounts of titanium metal powder having particle sizes in the range of from 1 nm to 120 $\mu$m, preferably from 1 nm to 400 nm, most preferably from 20 nm to 200 nm. This extremely fine titanium metal powder is highly desirable and could not be produced by prior art production methods.

It should be noted that titanium metal powder with a larger particle size (e.g., from 20–100 $\mu$m) can also be produced by the method of the present invention, for example by controlled agglomeration during vacuum distillation, which can be achieved, for example, by using a higher distillation temperature or a thicker bed of the solids that are subjected to vacuum distillation.

Figure 2:
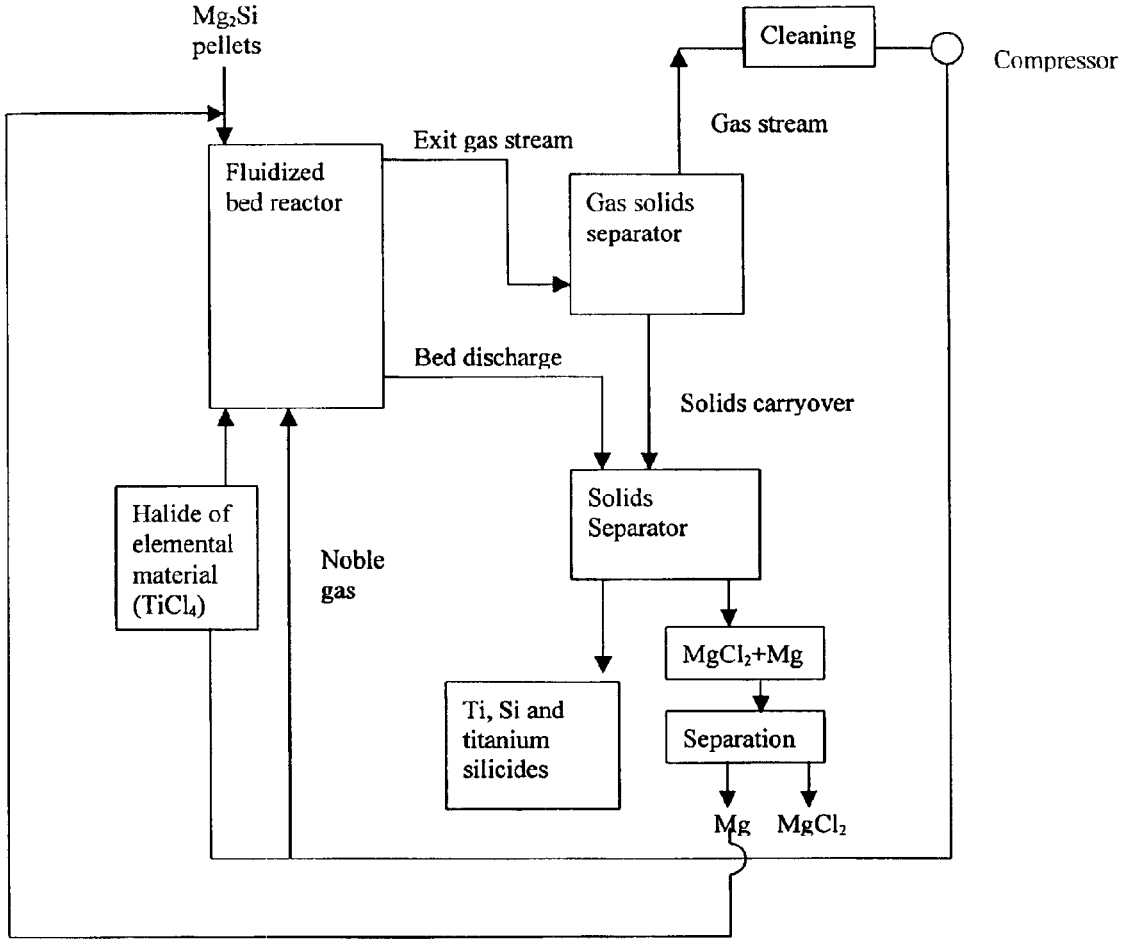
FIG. 2 is a schematic of a process according to the present invention for producing titanium silicides.

In another highly preferred embodiment of the present invention, shown in FIG. 2, the alloy material to be produced is titanium silicide powder, the halide of titanium is $TiCl_4$, the reducing agent is magnesium silicide ($Mg_2Si$) granules or pellets, and the fluidizing gas is a noble gas (e.g., argon). The $TiCl_4$ is fed into the fluidized bed reactor containing the magnesium silicide granules or pellets, which bed is being fluidized by a stream of the noble gas, and the $TiCl_4$ (in vapor form) reacts with the magnesium silicide to produce titanium metal powder, silicon powder, titanium silicides and $MgCl_2$, some of which are carried out of the reactor by the fluidizing gas along with some of the reducing agent. The temperature of the bed in the reactor is controlled so as to be in the range from about 550° C. to about 950° C., preferably from about 700° C. to about 950° C., most preferably in the range from about 800° C. to about 950° C. The temperature of the bed is controlled by the feed rate of $TiCl_4$ and the feed rate of the reducing agent.

The gas stream exiting the reactor is separated in a gas-solids separator to form a gas stream and a solids carryover. The gas stream, after cleaning, is compressed in a compressor and then sent back to the fluidized bed as part or all of the fluidizing stream. The solids stream along with the bed discharge is subjected to a separation step (e.g., leaching in a dilute acid bath or vacuum distillation) to separate the desirable reaction products (e.g., titanium metal powder, silicon powder and titanium silicides) from the halide of the reducing agent and the remains of the reducing agent. After this separation step, the bed material (i.e., the reducing agent after vacuum distillation) is preferably sent back to the bed, the halide of the reducing agent is removed as a by-product stream and the remaining products (e.g., titanium metal powder, silicon powder and titanium silicides) are collected and either separated from one another or reacted together to form additional or new titanium silicides.

The overall reactions can be summarized as:

$$TiCl_4+Mg_2Si+Si \rightarrow TiSi_2+2MgCl_2$$

and $$5TiCl_4+3Mg_2Si+4Mg \rightarrow Ti_5Si_3+10MgCl_2$$

As can be seen from the above reactions, the final silicide form depends on the relative amount of magnesium metal and silicon that are present during the reaction. For example, one way of increasing the amount of $Ti_5Si_3$ that is produced (if that is the desired silicide product) is to increase the relative amount of $TiCl_4$ that is fed to the reactor or to add magnesium metal to the bed of the reducing agent.

One of the differences between the process of the present invention and the known processes is that in the process of the present invention, the alloy/intermetallic compounds are produced directly from titanium halide, the reducing agent and/or alloy/intermetallic elements, which eliminates the expensive processing steps required for producing titanium metal powder which is then sintered with silicon powders to make titanium silicides as in the known process.

Another advantage of the present invention is that the reducing material or agent is in solid form. The use of a solid reducing agent provides many advantages which were heretofore overlooked. For example, the use of a reducing agent that is in solid form enables the effective use of a fluidized bed reactor, which is highly desirable due to the control over the process conditions that is afforded by this type of reactor. In addition, at the lower reaction temperatures that are used with a reducing agent in solid form, the elemental material (or alloy) is formed as a dry powder with less impurities (e.g., foreign material trapped in the elemental material as inclusions or stuck to the surface of the elemental material) than the elemental material that is formed by processes wherein the elemental material is partly or completely molten during the reaction process.

The lower reaction temperature also results in lower energy consumption, the ability to use reactors made of less expensive materials that would not withstand the higher reaction temperatures of the prior art processes, and less reactor maintenance, all of which will result in a lower final product cost.

Another advantage of the reducing agent being in solid state form is that it allows the whole process to be a closed system which makes a continuous process possible and eliminates the introduction of impurities during processing.

The fluidized bed that is used in the process of the present invention can be a bubbling fluidized bed, an entrained flow reactor, a circulating fluidized bed, a fast fluidized bed or any other similar type of reactor which is suitable for gas-solid reactions with excellent mass and heat transfer. Although the fluidized beds discussed above consist essentially of the reducing agent, it is also possible and in some cases desirable to use a fluidized bed material that comprises an inert media in combination with the reducing agent. The desirability of the use of an inert media in the fluidized bed material will depend on such factors as the particular feed material, reducing agent, production equipment and production conditions that are to be used. It is believed that such a modification to the fluidized bed composition is within the skill of the art and does not require further description or teachings herein to be successfully practiced.

Depending on the reaction conditions to be used and the composition of the reactor walls, it may be desirable to coat the interior surface(s) of the fluidized bed reactor with a protective layer to minimize contamination of the elemental material with impurities that are leached or otherwise removed from the reactor walls. For example, when the elemental material to be produced is titanium, the protective layer could be formed from titanium, a substance that will not alloy with titanium or a substance that is non-reactive with (or inert to) titanium.

The following Examples embody the invention, but should not be used to limit the scope of the invention in any way.

EXAMPLE 1

150 grams of magnesium granules (−20+100 mesh, Stock#00869, obtained from Alfa Aesar) were placed in a custom-made quartz fluidized bed reactor (55 mm ID, length=about 3 feet). A quartz fritted disc (55 mm diameter, made by Heraeus-Amersil) was used as the bed support. Argon was introduced at the bottom of the reactor as the fluidizing gas. The reactor was heated to 450° C. in a furnace while the bed was fluidizing. The superficial gas velocity of argon was 0.8 ft/sec and the flowrate was 14.4 liters/min. When the bed temperature reached 450° C., $TiCl_4$ vapor was introduced into the fluidized bed reactor to begin the reduction reaction. The $TiCl_4$ vapor was introduced into the fluidized bed reactor by passing some of the argon through a heated container holding $TiCl_4$ vapor and then feeding the exhaust stream from that container (i.e., argon and $TiCl_4$ vapor) into the bottom of the reactor. The bed temperature was gradually increased to 620° C., at which temperature the $TiCl_4$ being fed to the reactor was completely consumed in the reduction reaction (as indicated by the lack of formation of any titanium subchlorides) to form titanium powder and $MgCl_2$. The average flow rate of $TiCl_4$ was 0.43 g/min. After about nine hours, the flow of $TiCl_4$ vapor was stopped and the reactor was allowed to cool to room temperature while the flow of argon was maintained at a flowrate of 2 liters/min.

A cyclone was used to separate the entrained bed materials from the argon exhaust stream in the present laboratory scale experiment. Other methods such as ceramic membrane, electrostatic precipitation, gravity separator, centrifugal separator, fabric filters and any other method for gas-solid separation can also be used. The exhaust argon stream will be compressed and recycled back to the fluidized bed reactor in an industrial scale process. However, this was not practiced in the present laboratory scale experiment.

The solids collected from the bed and cyclone were washed with water first, then washed with an aqueous solution of hydrochloric acid (pH was controlled between 2–4 until the pH of the acid bath was stabilized) to remove unreacted magnesium. Once the pH of the acid bath was stabilized between 2–4, the slurry was filtered using a Gelman filter with 0.1 μm Millipore membrane and dried at 60° C. The powder obtained was identified as titanium metal by X-ray diffraction. The exposure of the titanium metal powder to water and the oxygen in air in the present experiment resulted in the formation of an oxide coating on the surface of the titanium powder particles. The benefit of the oxide coating is that it passivates the metal surface which makes the powder handling easier. This oxide coating can be prevented by controlling the processing conditions and the atmosphere that the titanium metal powder is exposed to after it is formed in the process of the present invention. For example, in an industrial process, by-products such as magnesium chloride and unreacted magnesium can be separated from the mixture by vacuum arc smelting and/or distillation so as to avoid the formation of oxide coatings on the titanium metal powder.

Figure 3:
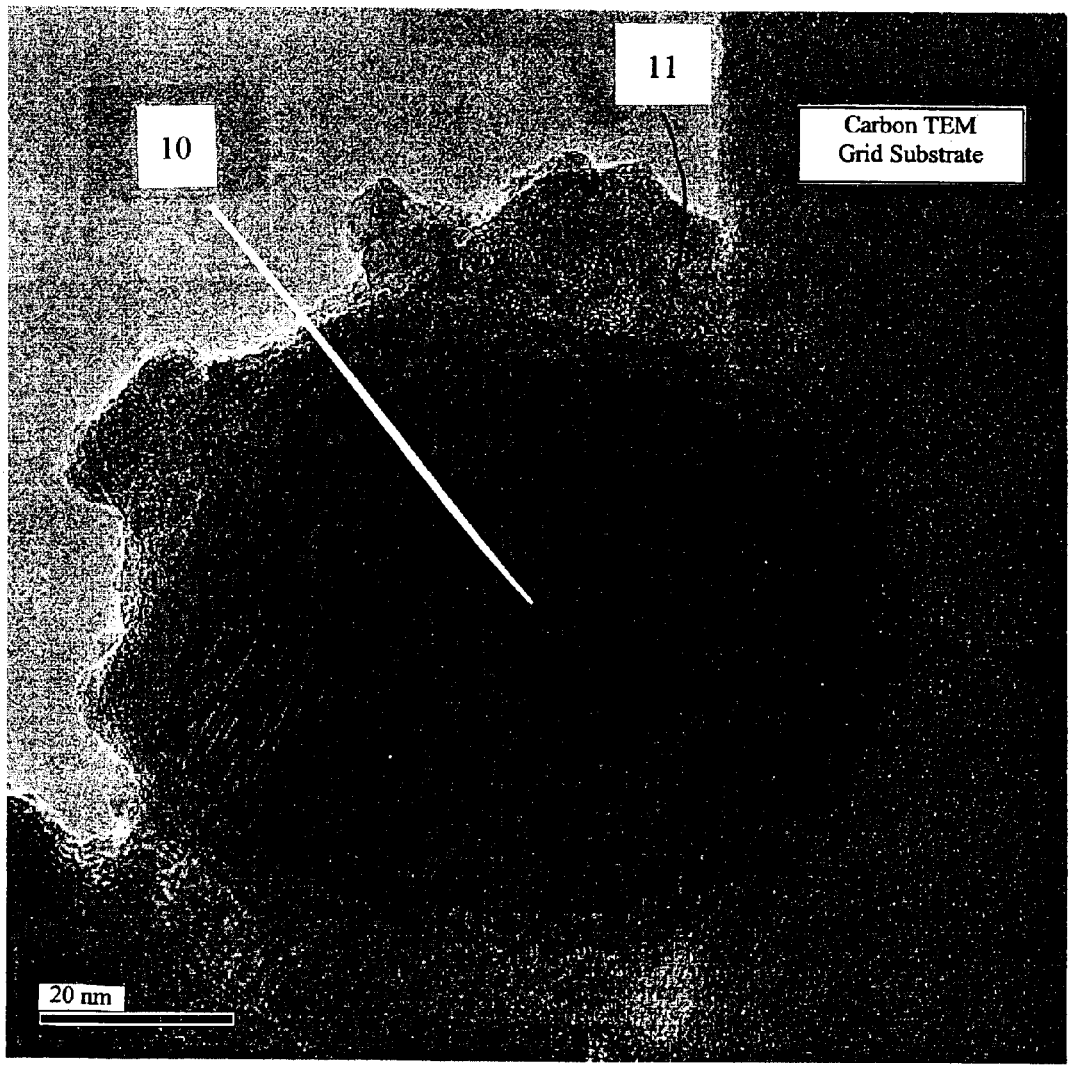
FIG. 3 is a TEM image of a single particle with a titanium metal core and a titanium oxide coating.

The particle size of the titanium powder was from 30 nm to 4 μm as measured by TEM (Transmitted Electron Microscope). A TEM image of a titanium metal particle is shown in FIG. 3. The titanium metal particle shown in FIG. 3 consists of a titanium metal core labeled number 10 and a titanium oxide coating labeled number 11.

One way to make the titanium metal powder finer is to make it in the slurry form instead of dried powder, which will eliminate fine particle agglomeration. This can be done by either reslurrying the filter cake (i.e., obtained from the Gelman filter) after filtration or by putting the acid leaching slurry (i.e., the slurry obtained from the acid bath before filtering) through a centrifuge.

For example, a slurry sample, after acid washing, was put into eight 50 ml centrifuge tubes in a centrifuge (Sorvall Super T21) at 13,000 rpm for 30 min. to settle the titanium metal powder from the magnesium salt solution. The supernatant solution in the tubes was decanted and replaced with deionized water to reslurry the settled Ti powder before being put back into the centrifuge. The process was repeated three times to wash out the magnesium and chloride ions. A TEM analysis showed that the primary particle size of the titanium metal powder after this centrifugation process was from 50–700 nm.

Another way to make the titanium metal powder finer is to vary the reaction conditions such as increasing the fluidizing gas flow rate, reducing the reaction temperature and/or quenching the product.

The use of the above conditions or processing steps in the process of the present invention can result in the production of large amounts of titanium metal powder with particle sizes in the range from 20 nm to 80 nm.

Separation of titanium powder from the by-products will be commercially conducted through vacuum distillation, in which magnesium metal and magnesium chloride will evaporate and be removed from the distillation device while titanium powder will remain. Titanium will remain in powder form due to its high melting point (1668° C.). However, it is preferred that the treatment temperature remain below 700° C., to avoid agglomeration of the titanium powder particles.

EXAMPLE 2

448 grams of a previously used bed which initially consisted of silicon (+140 mesh, a sample from Union Carbide), and, at the time of this experiment comprised 24% magnesium silicides and 76% of silicon, were placed in a custom-made quartz fluidized bed reactor (55 mm ID, length=about 3 feet). A quartz fritted disc (55 mm diameter, Heraeus-Amersil) was used as the bed support. The reactor was coated with TiN inside (by spray painting with a TiN paint) to prevent reaction between reductant metal and the quartz reactor. Argon was introduced at the bottom of the reactor as the fluidizing gas. The reactor was heated to 550° C. in a furnace while the bed was fluidizing. The superficial gas velocity of argon was 0.34 ft/s and the flowrate was 5.2 liters/min. When the bed temperature reached 550° C., $TiCl_4$ vapor was introduced into the fluidized bed reactor to begin the reduction reaction. After $TiCl_4$ was introduced for 29 minutes, 124 grams of magnesium metal particulate (obtained from Alfa Aesar, 20×100 mesh) were added to the bed under the inert argon atmosphere at a steady rate (~1.8 g/min) through a hopper which was attached to the reactor. The flow rate of $TiCl_4$ vapor in argon was about 3.2 g/min. The $TiCl_4$ vapor was introduced into the fluidized bed reactor in the same manner as described in Example 1. After 2.5 hours, the flow of $TiCl_4$ vapor was stopped and the reactor was allowed to cool to room temperature while the flow of argon was maintained at a flow rate of 410 ml/min.

The product obtained from the reactor was washed with water and the resulting slurry was then filtered and dried. The resulting powder was subjected to X-ray diffraction and SEM (scanning electron microscope) which indicated that the powder was composed of titanium metal, silicon, brucite ($MgOH_2$) and titanium silicides. SEM analysis indicated that the particle size of the titanium metal powder was from 5–75 μm.

It should be noted here that if the product obtained from the reactor is subjected to the acid washing step of example 1, after the water washing step and before being filtered and dried (as described in the preceding paragraph), the amount of brucite in the resulting powder can be reduced to low or even negligible levels.

If desired, it is possible to complete the reaction between the elemental silicon and titanium in the product and/or to modify the composition of the titanium silicides, by adjusting the titanium and silicon concentration in the mixture of the reaction products obtained from the reactor and then heating the adjusted mixture to sintering temperature.

As discussed previously, in an industrial process, by-products such as magnesium chloride and unreacted magnesium can be separated from the mixture by vacuum arc smelting and/or distillation so as to avoid the formation of oxide coatings on the titanium metal powder.

While the invention has been particularly shown and described with reference to preferred embodiments thereof, it will be understood by those skilled in the art that various changes in form and details may be made without departing from the spirit and scope of the invention as defined in the appended claims.

What is claimed is:

1. A process for the production of an elemental material, comprising the step of reacting a halide of the elemental material with a reducing agent in solid form in a fluidized bed reactor at a reaction temperature which is below the melting temperature of the reducing agent, wherein most or all of the halide of the elemental material is in vapor form during said reacting step, and further wherein the reducing agent consists essentially of one or more alkali metals or one or more alkaline earth metals.

2. The process of claim 1, wherein the elemental material is selected from the group consisting of Ti, Si, Zr, Hf, Al, As, In, Sb, Be, B, Ta, Ge, V, Nb, Mo, Ga, Ir, Os, U, Re, and the rare earth metals.

3. The process of claim 1, wherein the elemental material is titanium.

4. The process of claim 1, wherein the interior surface of the reactor is coated with a protective layer to minimize the contamination of the elemental material from the reactor material during the reaction.

5. The process of claim 4, wherein the protective layer is titanium, a substance that will not alloy with titanium or a substance that is non-reactive with titanium.

6. The process of claim 1, which comprises the additional steps of adding the reducing agent to the reactor, purging with noble gas to remove oxygen from the reactor, externally heating the reactor to the temperature below the melting temperature of the reducing agent, bringing the halide of the elemental material into contact with the reducing agent, and maintaining the reactor temperature below the melting temperature of the reducing agent.

7. The process of claim 1, wherein the reducing agent is in the form of particles and the elemental material is formed on the reducing agent particles.

8. The process of claim 1, comprising the additional step of separating the elemental material from unreacted reducing agent and the halide of the elemental material by washing with an aqueous acid solution.

9. The process of claim 1, wherein the elemental material is produced in the form of particles having a size of from 1 nm to 120 $\mu$m.

10. The process of claim 1, wherein the fluidized bed reactor uses a fluidizing gas stream which consists essentially of a noble gas and a halide of the elemental material and the reaction results in the production of the elemental material in powder form.

11. The process of claim 1, wherein the one or more alkali metals is or are selected from the group consisting of Na and K.

12. The process of claim 1, wherein the one or more alkaline earth metals is or are selected from the group consisting of Mg, Ca and Ba.

13. The process of claim 1, wherein the reducing agent is in the form of particles which have or develop porosity during the reduction reaction and the elemental material is formed on and in the reducing agent particles.

14. A process for the production of an alloy or an intermetallic compound of elemental materials, comprising the step of reacting halides of the elemental materials with a reducing agent in solid form in a fluidized bed reactor at a reaction temperature which is below the melting temperature of the reducing agent, wherein most or all of the halides of the elemental materials are in vapor form during said reacting step, and further wherein the reducing agent consists essentially of one or more alkali metals or one or more alkaline earth metals.

15. The process of claim 14, wherein each of the halides of the elemental materials is fed to the reactor in a proportion that is equivalent to the proportion of that elemental material in the alloy or intermetallic compound.

16. The process of claim 14, wherein the reaction results in a mixture of the elemental materials and the process comprises the further step of heating the mixture of the elemental materials to a temperature which is sufficient to form the alloy or intermetallic compound.

17. A process for the production of an elemental material, comprising the step of reacting a halide of the elemental material, in vapor form, with a reducing agent, in solid form, in a fluidized bed reactor at a reaction temperature which is below the melting temperature of the reducing agent, wherein the reducing agent consists essentially of one or more alkali metals or one or more alkaline earth metals.

18. A process for the production of an alloy or an intermetallic compound of elemental materials, comprising the step of reacting halides of the elemental materials, in vapor form, with a reducing agent, in solid form, in a fluidized bed reactor at a reaction temperature which is below the melting temperature of the reducing agent, wherein the reducing agent consists essentially of one or more alkali metals or one or more alkaline earth metals.

19. A process for the production of titanium metal powder, comprising the step of reacting a halide of titanium, in vapor form, with a reducing agent, in solid form, in a fluidized bed reactor at a reaction temperature which is below the melting temperature of the reducing agent, wherein the reducing agent consists essentially of one or more alkali metals or one or more alkaline earth metals.

* * * * *